US006007381A

United States Patent [19]

Ando et al.

[11] Patent Number: 6,007,381

[45] Date of Patent: Dec. 28, 1999

[54] CIRCUIT BOARD CONNECTOR WITH IMPROVED MOUNTING CHARACTERISTICS

[75] Inventors: Shigeru Ando, Yamato; Atsuhito Noda, Hachiohji; Shigeyuki Hoshikawa, Yamato, all of Japan

[73] Assignee: Molex Incorporated, Lisle, Ill.

[21] Appl. No.: 09/063,888

[22] Filed: Apr. 22, 1998

[30] Foreign Application Priority Data

Aug. 8, 1997 [JP] Japan ..... 9-227555

[51] Int. Cl.[6] ..... H01R 13/648

[52] U.S. Cl. ..... 439/607; 439/610

[58] Field of Search ..... 439/607, 608, 439/609, 610, 108

[56] References Cited

U.S. PATENT DOCUMENTS

| | | | |
|---|---|---|---|
| 5,013,262 | 5/1991 | Shibano | 439/610 |
| 5,017,156 | 5/1991 | Sugiyama | 439/607 |
| 5,035,652 | 7/1991 | Shibano | 439/610 |
| 5,073,130 | 12/1991 | Nakamura | 439/607 |
| 5,266,038 | 11/1993 | Nakamura | 439/79 |
| 5,338,215 | 8/1994 | Lee et al. | 439/188 |
| 5,637,015 | 6/1997 | Tan et al. | 439/607 |
| 5,755,595 | 5/1998 | Davis et al. | 439/607 |

*Primary Examiner*—Paula Bradley
*Assistant Examiner*—Alexander Gilman
*Attorney, Agent, or Firm*—Charles S. Cohen

[57] ABSTRACT

A shielded circuit board connector has an interior insulative connector housing with conductive terminals supported thereon. An exterior metal shell is fitted over the connector housing and partially encloses the connector housing and its associated terminals as well as partially defines a mating end of the connector for accommodating an opposing connector. The exterior shell includes a formed metal piece that has a top wall, two opposing sidewalls and two engaging bottom wall portions. A rear wall is formed with the top wall and is bent therefrom to cover the rear part of the connector housing, The rear wall of the exterior shell further includes two side wings that overlie the sidewalls of the shell when the shell is applied to a connector housing. Two pairs of mounting legs are formed on the shell for securely mounting the connector to a circuit board.

16 Claims, 3 Drawing Sheets

CIRCUIT BOARD CONNECTOR WITH IMPROVED MOUNTING CHARACTERISTICS

BACKGROUND OF THE INVENTION

The present invention relates generally to an electrical connector for connecting conductors of a cable to circuits on a printed circuit board, and more particularly, to an improved circuit board connector having an exterior shell covering the connector that provides a larger circuit path through the connector and which provides increased resistance to insertion and removal forces.

Conventional circuit board connectors include an insulative housing that supports a plurality of terminals. Such a connector is shown and described in published Japanese Utility Model Examined Publication No. 7-16312 and this connector includes an exterior metal cover that is press-fitted to at least part of the connector housing. A hollow, cylindrical section of the metal cover encircles the terminal contacts of the connector that are arranged at a forward part of the connector housing and further accommodates an opposing connector. The metal cover prevents electromagnetic interference from occurring in the circuits of the connector. The cover includes an inverted U-shaped section that lies adjacent its forward part, which encircles a corresponding forward part of the connector housing. This U-shaped section includes a top wall and two opposing sidewalls that overlie the top surface and opposite sides of connector housing near the rear part thereof. The opposing sidewalls of the U-shaped section each have pegs that extend from their lower longitudinal edges.

These pegs are press-fit into mounting holes of a circuit board when the connector is mounted thereon. The pegs are soldered to contact pads of a grounding circuit on the circuit board, while the solder tail portions of the connector terminals that extend out of the connector at its rear are also soldered to selected contact pads of the circuit. Such a connector is mounted on the circuit board solely by way of its two mounting pegs that are positioned at the end of the connector. Such a mounting arrangement does not have strong resistance to external forces that occur when the opposing connector is inserted into or removed from the circuit board connector. Because this connector is mounted only at its rear portion, the open end of the connector, is in effect, cantilevered out from the mounting pegs and repeated insertion and removal of an opposing connector into the hollow opening the connector metal cover will be likely to cause the board connector to either move or work loose from the circuit board, thereby causing an adverse effect on the connection between the connector terminal solder tail portions and the contact pads of the circuit board.

A need therefore exists for an improved circuit board connector that has strong resistance to external forces imparted to the connector during insertion and removal of an opposing connector thereto.

SUMMARY OF THE INVENTION

Accordingly, it is a general object of the present invention to provide an improved circuit board connector having an increased resistance to external forces, particularly external raising forces, the connector including pairs of mounting legs disposed at front and rear portions of the connector, the mounting legs being suitable for mounting the connector onto a circuit board.

Another object of the present invention is to provide a circuit board connector having an insulative connector housing, a plurality of conductive terminals disposed thereon, the terminals and the housing being enclosed by a metal grounding shield, the connector having two pairs of mounting legs, the respective pairs of mounting legs being disposed at front and rear portions of the connector and the mounting legs being formed from the metal shield.

It is another object of the present invention to provide an improved circuit board connector having a connector housing supporting a plurality of conductive terminals, the connector including an exterior metal grounding shield surrounding the connector housing, the connector housing and grounding shield each having an opening portion that cooperatively define a receptacle portion of the connector, the metal grounding shield being folded around the exterior of the connector housing and further including four mounting legs integrally formed therewith, the mounting legs extending down from the grounding shield at respective front and rear portions of the connector to thereby engage mounting holes on a circuit board to support the connector at its front and rear in order to resist detrimental external forces from moving the connector on the circuit board during insertion and or removal of an opposing connector.

To attain these objects, a connector constructed in accordance with the principles of the present invention includes an insulative connector housing having a plurality of conductive terminals supported thereon. The connector includes four mounting legs that depend down from the lower front and rear edges of opposing sides of the connector. An exterior metal shell in the form of a grounding shield or cover overlies the connector housing and may be press-fit thereon. This exterior metal shell encloses the contact portions of the connector terminals arranged near the front of the connector housing, and it also at least partly defines a mating end of the connector that accommodates an opposing connector.

In an important aspect of the present invention, the exterior metal shell is formed from a single conductive metal piece and includes an top wall and opposing sidewalls that overlie and cover the respective top and opposite sides of the rear part of the connector housing. The exterior metal shell also includes a rear wall with two side wing or cover portions that are folded orthogonally and overlie and cover the rear wall of the connector housing and the sidewalls of the metal shell, with the wing portions having openings formed therein that catch corresponding opposing engagement lugs formed in the sidewalls of the exterior shell. The opposing sidewalls of exterior shell have first mounting legs integrally formed therewith, while the overlying wing portions have second mounting legs integrally formed therewith. In this manner, the first mounting legs lie interior of second mounting legs.

Thus, a connector of the present invention has two mounting legs located on each side of its front and rear portions sections that stabilize the connector in position on the circuit board. Particularly, the two front mounting legs have the effect of increasing the resistance to undesirable external forces that would tend to raise the connector from the circuit board when an opposing connector is mated therewith or unmated therefrom.

As mentioned above, the opposing sidewalls of the exterior metal shell may be integrally connected to opposing longitudinal edges of the shell top wall, and the sidewalls of the shell may have length such that they extend around and upon a bottom wall of the connector housing and into engagement with each other. The ends of these sidewalls may have corresponding opposing dovetail projections and recesses for joining the sidewalls together. This engagement along the bottom surface of the connector has the effect of preventing the exterior metal shell from expanding when the connector is mated to or unmated from an opposing connector.

Still further, in an important aspect of the present invention, the exterior metal shell have one or more engagement members formed from its top and bottom walls and raised therefrom in order to engage a like exterior shell of an opposing connector. This structure has the effect of assuring that the exterior shells of both the connector and opposing connector are at the same ground potential when they are mated together.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENT

Figure 1:
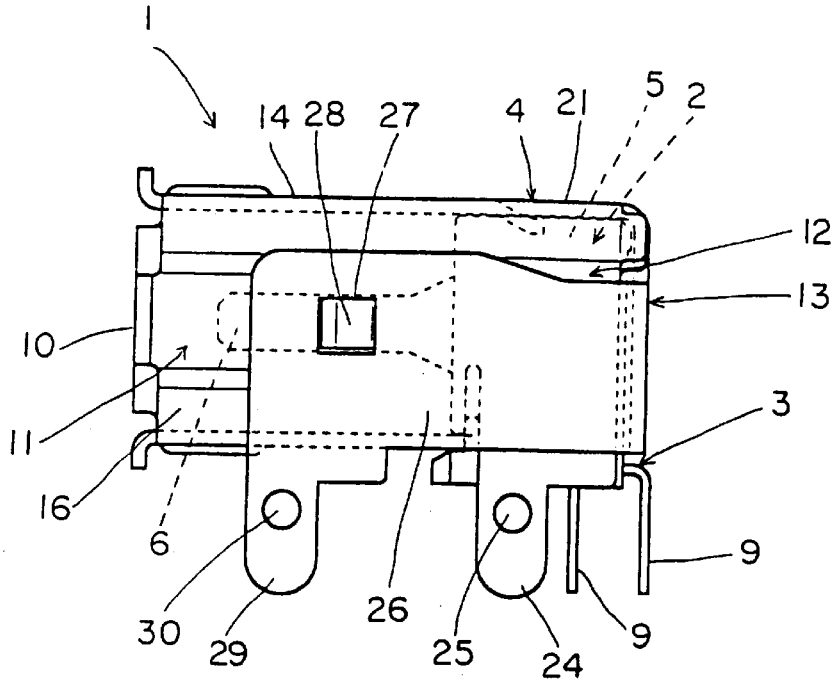
FIG. 1 is a side elevational view of a shielded connector constructed in accordance with the principles of the present invention.

Referring now to the drawings, and in particular to FIG. 1, a shielded connector constructed in accordance with the principles of the present invention is generally designated as 1. The connector 1 is of the type that is mounted to a printed circuit board 33 (FIG. 6) that would be commonly found within a computer and the connector 1 may be used for connecting peripheral devices to the computer. The connector 1 includes an interior insulative connector housing 2 that supports a plurality of terminals 3 thereon and a metal grounding, or interference shell 4 that is fit upon the connector housing 2.

Figure 2:
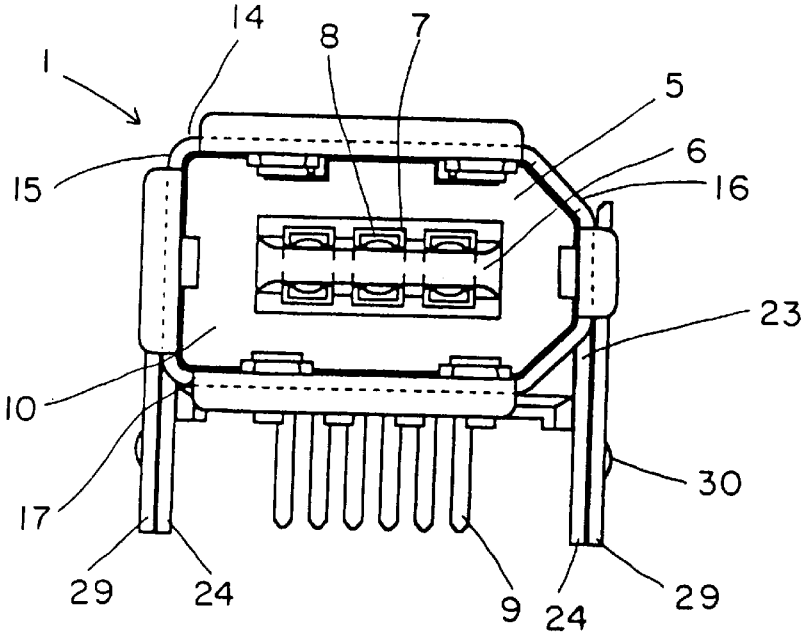
FIG. 2 is a front elevational view of the connector of FIG. 1.
Figure 3:
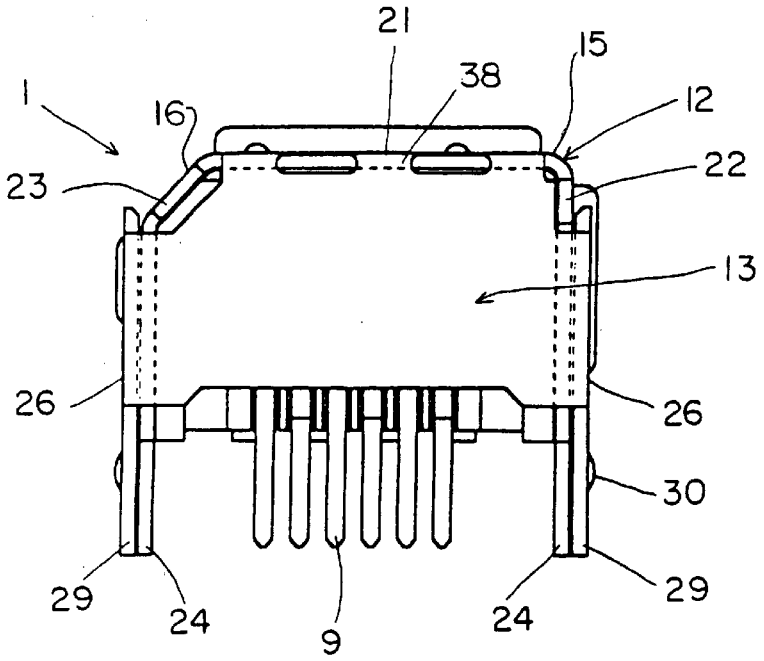
FIG. 3 is a rear elevational view of the connector of FIG. 1.

The connector housing 2 is typically molded from a synthetic resin material, and may be considered as having a rear body portion 5, illustrated at the right side of FIG. 1, and a front plug or mating portion 6, illustrated at the left side of FIG. 1. In the embodiment illustrated, the front plug portion 6 extends from the front center area of the connector housing rear block 5 in the form of thick, flat plate. The connector housing 2 supports a plurality of conductive terminals 3 that are typically stamped out of a thin, conductive metal sheet. Each of the terminals 3 includes a contact portion 8 at one end and a solder tail portion 9 at the other end. Each connector terminal 3 may be accommodated within a corresponding terminal hole, or slot 7, (FIG. 2) with its contact portion laid on the upper or lower surface of the front plug portion 6 and with its solder tail portion 9 depending downwardly therefrom and through the bottom of the rear block section 5 at the rear of the connector 1.

The exterior shell 4 is also stamped out of a thin, conductive metal sheet and is provided as a single, integral piece. The shell 4 provides an elongated, hollow engagement portion 11 that encloses the terminal contact portions 8 that are arranged at the front plug portion 6 of the connector housing. The shell 4 also defines in cooperation with the connector housing 2, a mating end 10 of the circuit board connector 1 that mates with an opposing connector (not shown) that is accommodated within the hollow engagement portion 10. In this regard, the shell 4 includes a body portion 12 that has what may be considered as an inverted and somewhat U-shaped section that is disposed adjacent to and just rearward of a rear edge of the hollow engagement portion 11, and a rear wall 13 that depends from the rear edge of a top wall 14 of the shell body portion 12 in order to cover the rear end of the connector housing 2.

The hollow engagement portion 11 and rear body portion 12 of the exterior shell 4 include a top wall 14, two opposing sidewalls 22 and 23 that are integrally connected to and depend from opposing longitudinal edges 15, 16 of the top wall 14, as well as two complementary bottom half portions 17*a* and 17*b* that are integrally connected to the lower, longitudinal edges of the opposing sidewalls 22 and 23. One such bottom half portion 17*a* has a projection 18*a* with a dovetail configuration, while the other such bottom half 17*b* has a recess 18*b* with a complementary dovetail configuration. The two dovetailed elements 18*a*, 18*b* have angled surfaces 19*a*, 19*b* that engage each other to form a bottom wall 17 of the exterior shell 4 that preferably overlies the bottom surface(s) of the connector housing 2. The engagement of the two bottom half portions 17*a*, 17*b* in effect, prevent expansion of the shell engagement portion 11 (and the rear body portion 12 thereof) during insertion and removal of an opposing connector in and from the board connector 1.

One of the two sidewalls 23 includes an angled shoulder or edge portion 16 that provides a polarizing aspect to the connector 1 that ensures the opposing connector will be properly aligned for mating with the board connector 1. In order to facilitate and ensure a reliable connection between the two connectors, the shell hollow engagement portion 11 may include one or more engagement members 20 that are stamped from the top and bottom walls 14, 17 and raised partly therefrom. These engagement members 20 to catch the opposing shell cover of the opposing connector.

The rear body portion 12 that lies adjacent the hollow engagement portion 11 includes a top wall 21 that overlies and covers an adjoining top surface of the connector housing rear body portion 5. The two aforementioned opposing sidewalls 22, 23 are also connected to and depend down from this top wall 21 in order to cover opposing sides of the rear body portion 5 of the connector housing 2. This top wall 21 is continuous with the top wall 14 of the hollow engagement portion 11. In an important aspect of the present invention, the two sidewalls 22, 23 include a first pair of mounting posts, or legs, 24 integrally connected thereto and along the lower edges of the sidewalls 22 and 23. These first mounting legs 24 may include small, rounded projections 25 formed thereon that extend out from the mounting legs 24 and abut the edges 34 of the mounting holes 35 disposed in the circuit board 33. The first mounting legs 24 extend down beyond the bottom wall 17 of the exterior shell 4 and enter into the circuit board mounting holes 35.

The rear wall 13 of the exterior shell 4 depends down from the top wall 21 of the shell body portion 12 along the rear lateral edge thereof into a covering relationship over the rear end of the connector housing 2. Importantly, this rear wall 13 includes a pair of extension walls, or wing portions, 26 that are integrally formed therewith and which extend forward from opposite sides 36 of the rear wall 13. These extension walls 26 overlie and cover a portion of the opposing sidewalls 22, 23 of the shell body portion 12. In order to facilitate engagement with the sidewalls 22, 23 of the exterior shell 4, each such wing portion 26 may preferably include an opening, or window 27, formed therein that catches therein an engagement lug 28 formed in the sidewalls of the hollow engagement portion 11. This engagement prevents the opposing sidewalls 22, 23 from displacing during engagement cycles of the board connector 1 with an opposing connector.

The extension walls 26 also have mounting posts, or legs 29 integrally formed therewith and depending down from their respective forward, lower edges 37. These mounting legs 29 also may have small projections 30 formed thereon to facilitate engagement with the mounting holes 35 of the circuit board 33. Because the front mounting legs 29 are formed from the extension walls 26 of the shell, they are disposed exterior of the first mounting legs 24, as shown best in FIG. 2.

Figure 4:
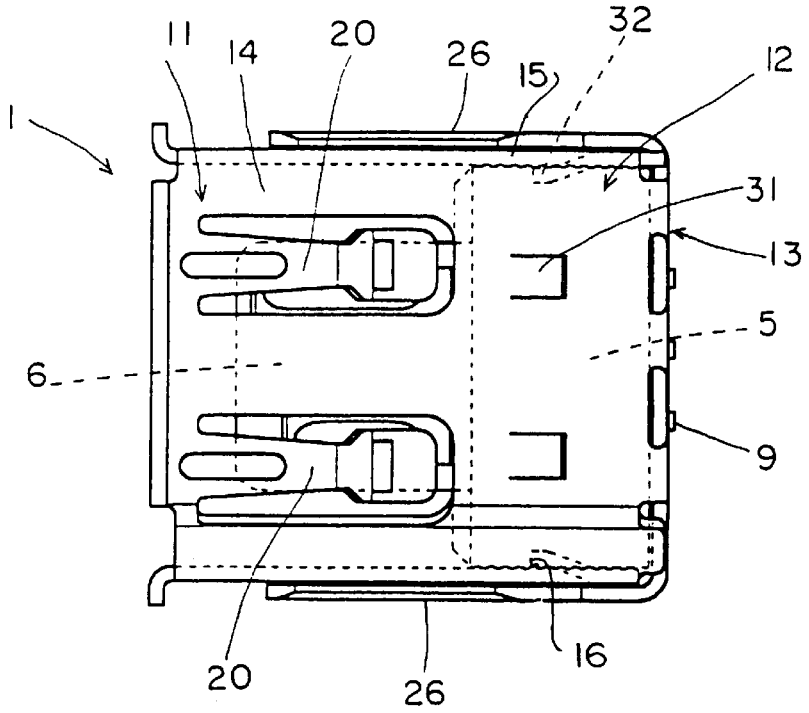
FIG. 4 is a top plan view of the connector of FIG. 1.
Figure 5:
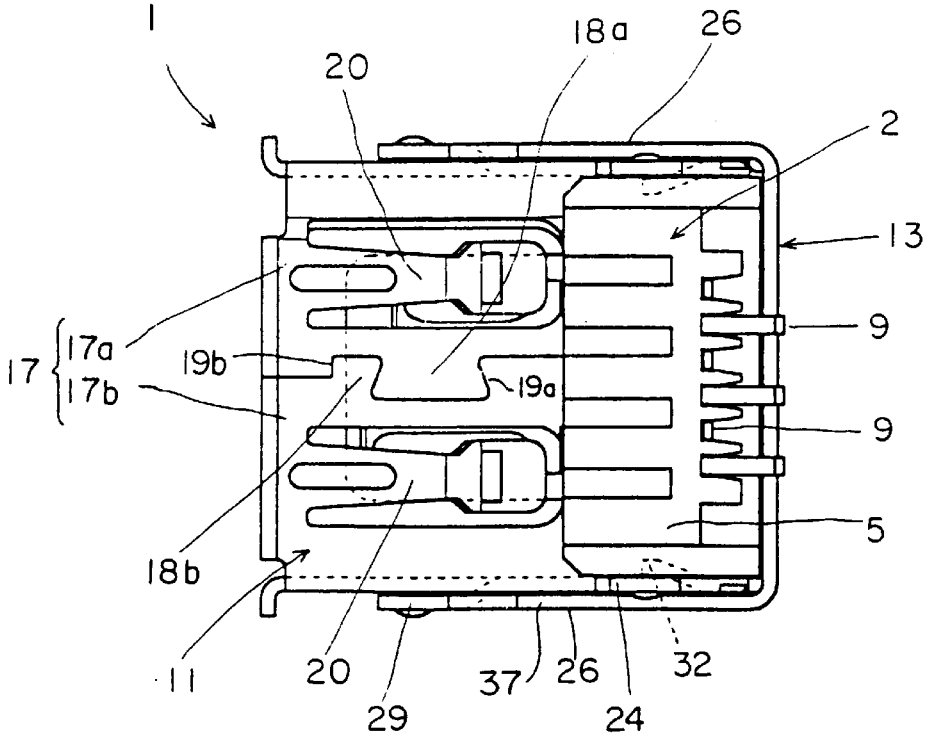
FIG. 5 is a bottom plan view of the connector of FIG. 1.

In mounting the exterior shell 4 onto the connector housing 2, the shell 4 is initially prepared in a U-shape with the opposing sidewalls 22, 23 bent downward and with its rear wall 13 unbent and extending rearwardly from the top walls 14, 21 of the shell 4. The connector housing 2 with its terminals 3 mounted thereon, is inserted from the rear of this initially formed shell 4 until a pair of inwardly projecting catch members 31 (FIG. 4) of the top wall 21 of rear body portion 12 of the shell 4 are caught within opposing recesses formed in upper surface of the rear body portion 5 of the connector housing 2. Likewise, a pair of catch members 32 formed within the opposing sidewalls 22, 23 (FIG. 4) are also received within opposing recesses formed in the sides of the connector housing 2.

Next, the rear wall 13 of the shell 4 is bent down from its initial position along the rear edge 38 of the shell top wall 21 until it contacts the rear surface of the connector housing 2 and closes off the rear opening of the shell 4. Then, the extension walls 26 are folded along the rear vertical edges 36 of the rear wall 13 onto the opposing sidewalls 22, 23 until their respective engagement windows 27 overlie and catch the engagement lugs 28 of the underlying sidewalls 22, 23.

Figure 6:
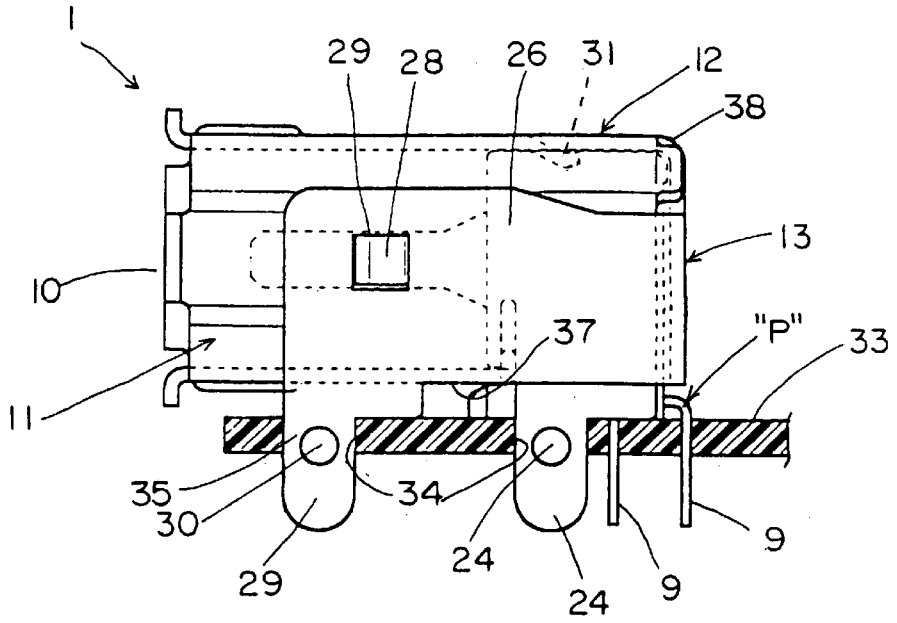
FIG. 6 is a side elevational view of the connector of FIG. 1, partly in section, illustrating how the connector may be mounted to a circuit board.

Referring now to FIG. 6, the connector 1 is shown as being mounted onto a circuit board 33 with its two pairs of mounting legs 24, 29 inserted in the circuit board mounting holes 35. The terminal solder tail portions 9 then may be soldered to opposing contact pads or traces (not shown), while the pairs of mounting legs 24 and 29 are soldered to these contacts. As seen in FIG. 1, the connector 1 is thereby fixed to the circuit board 33 by way of its four mounting legs 24 and 29 in a manner that substantially increases the strength that the connector 1 is fixed to the circuit board 33. The second mounting legs 29 of the connector that are positioned near the front of the connector 1 and which extend from the extension walls 26 thereof are positioned beneath the hollow engagement portion 11 of the connector 1. These front mounting legs 29 will resist external forces that are applied to the connector, and especially the hollow engagement portion 11 when the opposing connector is either inserted into or removed from the circuit board connector 1. Furthermore, the front mounting legs 29 eliminate any cantilevered structure of the connector 1 which would occur if the connector 1 only had its rear mounting legs 24 to support. Repetition of mating the two connectors together will therefore cause no detrimental movement of the connector 1 or any unbalanced moment around the terminal solder tail portions 9 at P that might result in breakage of the solder tails 9 or their connection to the circuit board 33, thereby increasing the reliability of the connection.

The four engagement members 20 of the top wall 14 and bottom wall 17 will slidably contact the shell of the opposing connector when mated with the circuit board connector 1. This contact ensures that the two connector shells are at the same electrical potential which will typically be a ground potential. The two complementary bottom half portions 17*a*, 17*b* are jointed together by inserting the dovetail projection 18*a* into the dovetail recess 18*b* to thereby prevent undesired expansion of the hollow engagement portion 11 even during repeated insertion and removal cycles of the two connectors.

While the preferred embodiment of the invention have been shown and described, it will be apparent to those skilled in the art that changes and modifications may be made therein without departing from the spirit of the invention, the scope of which is defined by the appended claims.

We claim:

1. A right angle circuit board connector for effecting a connection between circuits on a circuit board and a mating electrical connector, the connector having improved mounting characteristics, said connector comprising:

a right angle insulative connector housing;

a plurality of conductive right angle terminals supported on a support surface of the connector housing, the terminals having contact portions and tail portions, the terminal contact portions being supported on said connector housing support surface and the terminal tail portions extending out of said connector housing in position for attachment to the circuit board;

the connector having opposed front and rear portions and a receptacle disposed near the front portion for receiving a mating portion of said mating connector therein, said connector housing support surface and said terminal contact portions being disposed within the receptacle;

a conductive exterior shell at least partially enclosing said connector housing, the exterior shell having a body portion that overlies part of said connector housing and further having an engagement portion extending from the shell body portion and at least partially defining said connector receptacle, said exterior shell having top and bottom walls and a pair of opposing sidewalls interconnecting the top and bottom walls together;

said connector further having first and second pairs of mounting legs for engaging said circuit board when said connector is mounted thereto, one leg of each pair being positioned generally along two substantially parallel edges of said connector, the first and second pairs of mounting legs being formed from said exterior shell and positioned near said connector front and rear portions, respectively, thereby providing increased resistance to detrimental external forces applied during insertion or removal of said mating connector into said connector receptacle;

said exterior shell and said first and second pairs of mounting legs being integrally formed together from a single, conductive metal plate such that said exterior shell provides an exterior grounding shield for said connector and wherein said first and second pairs of mounting legs provide a plurality of conductive paths from said grounding shield to a grounding circuit on said circuit board when said connector is mounted thereon; and said first pair of mounting legs being positioned near said rear of said connector and said second pair of mounting legs being positioned near said front of said connector, said first pair of mounting legs being further positioned interior of said second pair of mounting legs.

2. The circuit board connector as defined in claim 1, wherein each of said first and second mounting legs each include a post portion that is received within a corresponding, opposing opening of said circuit board when said connector is mounted to said circuit board; and, said first pair of mounting legs being disposed on said exterior shell so as to support said shell body portion and said second pair of mounting legs being disposed on said exterior shell so as to support said shell engagement portion on said circuit board when said connector is mounted to said circuit board.

3. The circuit board connector as defined in claim 1, wherein said exterior shell includes a rear wall integrally connected to said shell top wall, the shell rear wall including a pair of extension walls extending at an angle from said shell rear wall over said shell sidewalls in a manner so as to contact and cover portions of said shell sidewalls.

4. The circuit board connector as defined in claim 1, wherein said exterior shell engagement portion is hollow and includes engagement lugs respectively formed with and raised from said shell top wall and bottom wall, the engagement lugs extending from said shell in a manner so as to engage an outer shell of said opposing connector when said opposing connector is mated to said connector.

5. The circuit board connector as defined in claim 1, wherein said exterior shell engagement portion is hollow and said first pair of mounting legs is disposed on said exterior shell alongside said body portion thereof and said second pair of mounting legs is disposed on said exterior shell alongside said engagement portion thereof, and said terminal solder tail portions exiting said connector rearward of said first and second pairs of mounting legs.

6. A right angle circuit board connector for effecting a connection between circuits on a circuit board and a mating connector that is matable with the circuit board connector, said circuit board connector comprising:

a right angle insulative connector housing supporting a plurality of conductive right angle terminals;

the terminals having contact portions supported on a support surface of the connector housing, said terminals having tail portions extending out of said connector housing in position for attachment to one of said circuits disposed on the circuit board when said circuit board connector is mounted to said circuit board;

said circuit board connector having a mating face for engaging an opposing mating face of the mating connector;

an exterior conductive shell at least partially enclosing said connector housing and the connector mating face, the exterior shell defining an interference shield of said circuit board connector, said exterior shell having interconnected body and engagement portions, the exterior shell body portion being disposed adjacent said connector housing and said exterior shell engagement portion being disposed forward of and adjacent to said exterior shell body portion and at least partially defining an opening of said circuit board connector that receives therein said opposing mating face of said mating connector when said mating connector is mated to said circuit board connector;

said exterior shell including a top wall, a bottom wall, two opposing sidewalls interconnecting the shell top and bottom walls together to form a receptacle that receives said connector housing therein, a rear wall interconnected to said shell top wall and extending downwardly therefrom to close off a portion of said receptacle means for mounting said circuit board connector to said circuit board, said connector, and mounting means including first and second pairs of mounting legs formed as part of said exterior shell and extending therefrom for engaging at least one circuit on said circuit board when said circuit board connector is mounted to said circuit board, one leg of each pair being positioned generally along two substantially parallel edges of said connector;

the first pair of mounting legs extending from said exterior shell body portion so as to support said exterior shell body portion upon said circuit board when said circuit board connector is mounted to said circuit board and the second pair of mounting legs extending from said exterior shell engagement portion so as to support said exterior shell engagement portion upon said circuit board when said circuit board connector is mounted to said circuit board, said first and second pairs of mounting legs being spaced apart from each other lengthwise of said connector and said terminals exiting from said receptacle rearward of said second pair of mounting legs.

7. The circuit board connector of claim 6, wherein said exterior shell and said first and second pairs of mounting legs are formed from a single conductive metal plate, whereby said exterior shell provides an exterior grounding shield for said circuit board connector and said first and second pairs of mounting legs provide connections between said exterior shell and said circuit board at least one circuit on said circuit board when said circuit board connector is mounted to said circuit board.

8. The circuit board connector of claim 7, wherein said first pair of mounting legs are disposed interior of said second pair of mounting legs.

9. The circuit board connector of claim 6, wherein said shell rear wall includes a pair of wing walls formed therewith, the shell wing walls extending from said shell rear wall forwardly and overlying said shell sidewalls, said shell sidewalls having respective engagement lugs formed therein, and said shell wing walls having corresponding openings formed therein that receive said shell sidewall engagement lugs therein in a manner such that said shell wing walls are retained in place over said shell sidewalls.

10. A right angle circuit board connector for establishing a connection between predetermined circuits on a circuit board and a mating connector, said connector comprising:

a right angle connector housing;

a plurality of conductive right angle terminals supported by the connector housing;

said connector having respective front and rear portions, said connector including an open cavity defined thereon for receiving a mating portion of said mating connector at said front portion therein, said conductive terminals being disposed within the open cavity and extending out of said connector near said rear portion thereof;

an exterior conductive grounding shell at least partially enclosing said connector housing and at least partially defining said open slot;

said exterior shell including sets of first and second pairs of mounting legs, one leg of each pair being positioned generally along two substantially parallel edges thereof for mounting said connector to said circuit board, said first pair of mounting legs being disposed near said connector rear portion and said second pair of mounting legs being disposed near said connector front portion, said first and second pairs of mounting legs being disposed forwardly of a location where said terminals extend out of said connector;

said exterior shell including a top wall and a bottom wall, two opposing sidewalls joining said top and bottom walls together, said exterior shell further including a rear wall joined to said top wall and extending down therefrom between said sidewalls, the rear wall including a pair of cover portions that extend therefrom alongside and over portions of said sidewalls, said first pair of mounting legs being integrally formed with and extending from said sidewalls and said second pair of mounting legs being integrally formed with and extending from said rear wall cover portions, said first and second pairs of mounting legs providing a plurality of individual ground paths between said exterior shell and at least one grounding circuit on said circuit board when said connector is mounted to said circuit board.

11. The circuit board connector as set forth in claim 10, wherein said first pair of mounting legs lie interior of said second pair of mounting legs.

12. The circuit board connector as set forth in claim 10, wherein said top and sidewalls each include members for engaging said connector housing.

13. The circuit board connector as set forth in claim 10, wherein said rear wall side cover portions include openings that receive engagement lugs formed on said sidewalls.

14. The circuit board connector as set forth in claim 10, wherein said exterior shell bottom wall includes two interengaging half portions.

15. A right angle circuit board connector for effecting a connection between circuits on a circuit board and a mating electrical connector, the connector having improved mounting characteristics, said connector comprising:

a right angle insulative connector housing;

a plurality of conductive right angle terminals supported on a support surface of the connector housing, the terminals having contact portions and tail portions, the terminal contact portions being supported on said connector housing support surface and the terminal tail portions extending out of said connector housing in position for attachment to the circuit board;

the connector having opposed front and rear portions and a receptacle disposed near the front portion for receiving a mating portion of said mating connector therein, said connector housing support surface and said terminal contact portions being disposed within the receptacle;

a conductive exterior shell at least partially enclosing said connector housing, the exterior shell having a body portion that overlies part of said connector housing and further having an engagement portion extending from the shell body portion and at least partially defining said connector receptacle, said exterior shell having top and bottom walls and a pair of opposing sidewalls interconnecting the top and bottom walls together, said exterior shell further including a rear wall having a pair of opposing extension walls integrally connected thereto that are folded over and upon said shell sidewalls, said shell top wall being integrally connected with rear wall and said sidewalls;

said connector further having first and second pairs of mounting legs for engaging said circuit board when said connector is mounted thereto, said first pair of mounting legs being integrally connected to said sidewalls and said second pair of mounting legs being integrally connected to said extension walls, one leg of each pair being positioned generally along two substantially parallel edges of said connector, the first and second pairs of mounting legs being formed from said exterior shell and positioned near said connector front and rear portions, respectively, thereby providing increased resistance to detrimental external forces applied during insertion or removal of said mating connector into said connector receptacle; and, said exterior shell and said first and second pairs of mounting legs being integrally formed together from a single, conductive metal plate such that said exterior shell provides an exterior grounding shield for said connector and wherein said first and second pairs of mounting legs provide a plurality of conductive paths from said grounding shield to a grounding circuit on said circuit board when said connector is mounted thereon.

16. The circuit board connector as defined in claim 15, wherein said extension walls include openings formed therein and said sidewalls include engagement lugs formed therein and extending outwardly therefrom, said extension wall openings being aligned with said engagement lugs such that when said extension walls are folded upon said shell sidewalls, said engagement lugs engage said openings.

* * * * *